US007469903B2

(12) United States Patent
Marshall et al.

(10) Patent No.: US 7,469,903 B2
(45) Date of Patent: Dec. 30, 2008

(54) TARGET CLAMPING SYSTEM

(75) Inventors: Thomas Marshall, Lakeshore, UT (US); Nicolas Stincelli, Springville, UT (US); Thomas R. Wright, Highland, UT (US); Kyle E. Bateman, Provo, UT (US)

(73) Assignee: Action Target Acquisition Corp., Provo, UT (US)

( * ) Notice: Subject to any disclaimer, the term of this patent is extended or adjusted under 35 U.S.C. 154(b) by 0 days.

(21) Appl. No.: 11/506,764

(22) Filed: Aug. 18, 2006

(65) Prior Publication Data

US 2007/0040334 A1 Feb. 22, 2007

Related U.S. Application Data

(60) Provisional application No. 60/709,783, filed on Aug. 19, 2005.

(51) Int. Cl.
*F41J 1/10* (2006.01)
*A44B 21/00* (2006.01)

(52) U.S. Cl. ..... 273/407; 24/514; 24/469; 24/498; 24/515

(58) Field of Classification Search ..... 273/403–410; 24/514, 569

See application file for complete search history.

(56) References Cited

U.S. PATENT DOCUMENTS

| | | | | | |
|---|---|---|---|---|---|
| 631,175 | A | | 8/1899 | Parnall | |
| 1,738,874 | A | | 12/1929 | Domingo | |
| 2,284,510 | A | | 5/1942 | Cates | |
| 3,087,701 | A | | 4/1963 | Wallace | |
| 3,515,388 | A | | 6/1970 | Zachmeier | |
| 3,540,729 | A | * | 11/1970 | Rahberger | 273/407 |
| 3,914,879 | A | | 10/1975 | Taylor, III | |
| 4,084,299 | A | | 4/1978 | Noda | |
| 4,228,569 | A | | 10/1980 | Snyder | |
| 4,232,867 | A | | 11/1980 | Tate, Sr. | |
| 4,506,416 | A | | 3/1985 | Ohminato et al. | |
| 4,540,182 | A | | 9/1985 | Clement | |
| 4,911,453 | A | | 3/1990 | Essex et al. | |
| 5,067,683 | A | * | 11/1991 | Wager | 248/545 |
| 5,163,689 | A | | 11/1992 | Bateman et al. | |
| 5,209,492 | A | * | 5/1993 | Hamilton | 273/407 |
| 5,240,258 | A | | 8/1993 | Bateman | |
| 5,242,172 | A | | 9/1993 | Bateman | |
| 5,277,432 | A | | 1/1994 | Bateman | |
| 5,350,180 | A | | 9/1994 | Acock | |
| 5,400,692 | A | | 3/1995 | Bateman et al. | |
| 5,535,662 | A | | 7/1996 | Bateman et al. | |
| 5,586,373 | A | * | 12/1996 | Eby et al. | 24/525 |
| 5,621,950 | A | | 4/1997 | White | |
| 5,676,378 | A | | 10/1997 | West | |
| 5,678,824 | A | * | 10/1997 | Fortier et al. | 273/407 |
| 5,811,718 | A | | 9/1998 | Bateman et al. | |

(Continued)

OTHER PUBLICATIONS

U.S. Appl. No. 10/287,191, filed Nov. 4, 2002, Bateman et al.

(Continued)

*Primary Examiner*—Mark S Graham
(74) *Attorney, Agent, or Firm*—Bateman IP Law Group

(57) ABSTRACT

An improved target clamp more securely holds a target in place when impacted by bullets or moved quickly by a target actuator.

7 Claims, 6 Drawing Sheets

U.S. PATENT DOCUMENTS 5,822,936 A 10/1998 Bateman et al.
5,938,203 A * 8/1999 Beckwith, Sr. ..... 273/407
5,967,523 A 10/1999 Brownlee
6,311,980 B1 11/2001 Sovine et al.
6,325,376 B1 12/2001 Elliott et al.
6,378,870 B1 4/2002 Sovine et al.
6,484,990 B1 11/2002 Marshall
6,533,280 B1 3/2003 Sovine et al.
6,543,778 B2 4/2003 Baker
6,588,759 B1 7/2003 Bateman et al.
6,776,418 B1 8/2004 Sovine et al.
6,808,177 B2 10/2004 Dehart
6,808,178 B1 10/2004 Sovine et al.
6,975,859 B1 12/2005 Lambert et al.
6,994,348 B2 2/2006 Lambert et al.
6,994,349 B2 2/2006 Lambert et al.
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
2005/0022658 A1 2/2005 Bateman et al.
2006/0234069 A1 10/2006 Sovine et al.
2006/0240388 A1 10/2006 Marshall et al.
2006/0240391 A1 10/2006 Sovine et al.
2007/0045965 A1 3/2007 Bateman et al.
2007/0069472 A1 3/2007 Lambert et al.
2007/0072537 A1 3/2007 Bateman et al.
2007/0102883 A1 5/2007 Parks et al.
2007/0114724 A1 5/2007 Bassett et al.
2007/0235943 A1 10/2007 Bateman et al.
2008/0022847 A1 1/2008 Bateman et al.

OTHER PUBLICATIONS

U.S. Appl. No. 11/494,788, filed Jul. 26, 2006, Bateman et al.
U.S. Appl. No. 11/349,739, filed Feb. 8, 2006, Bateman et al.
U.S. Appl. No. 11/349,738, filed Feb. 8, 2006, Bateman et al.
U.S. Appl. No. 11/506,763, filed Aug. 18, 2006, Sovine et al.
U.S. Appl. No. 11/506,413, filed Aug. 17, 2006, Wright et al.
U.S. Appl. No. 11/530,280, filed Sep. 8, 2006, Marshall et al.
U.S. Appl. No. 11/745,077, filed May 7, 2007, Bassett et al.
U.S. Appl. No. 11/781,187, filed Jul. 20, 2007, Bateman et al.

* cited by examiner

TARGET CLAMPING SYSTEM

RELATED APPLICATIONS

The present application claims the benefit of U.S. Provisional Application No. 60/709,783, filed Aug. 19, 2005.

BACKGROUND OF THE INVENTION

1. The Field of the Invention

The present invention relates to target clamps. More specifically, the present invention relates to an improved target clamp which more securely holds a shooting target to a target actuator and keeps the target securely clamped in place when the target is moved by the actuator.

2. State of the Art

It is common for law enforcement officers and others to engage in target practice to maintain their shooting accuracy. Law enforcement officers often use various methods of target practice to maintain and improve shooting accuracy. Frequently, an actuation mechanism is used to move targets in a manner which tests the law officers' accuracy and response time in shooting at moving or turning targets. This method of target practice provides improved training for real life scenarios, such as criminals suddenly appearing from behind a door, wall etc. and helps the officers develop quick reflexes and the ability to quickly determine whether a person poses a threat.

Targets are commonly formed from a sheet of paper, cardboard, or similar disposable material. The targets can be secured directly to a target actuator, or more commonly may be secured to one or more wooden posts, such as a 1×2 post, or other similar material which is clamped or secured to a target actuator. The target or the mounting post is often clamped to the target actuator.

Available target mounting systems frequently allow the target to become loose and slip or detach from the target clamping system. The repeated force of bullets impacting the target and the forces caused by sudden turning of the targets often cause the targets to slip or move out of the desired mounting position.

There is thus a need for a target clamp which overcomes the limitations of available target clamps by more securely holding the target or target mounting post during use.

SUMMARY OF THE INVENTION

It is an object of the present invention to provide an improved target clamp.

According to one aspect of the invention, a target clamp is provided which more securely clamps a target to a desired mount. The target clamp may be used to clamp a target to a target actuator and more securely hold the target in place when moved by the actuator.

These and other aspects of the present invention are realized in a target clamp as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention. It is appreciated that not all aspects of the invention may be clearly shown in a single figure. Thus, multiple figures may be used to illustrate the various aspects of a single embodiment of the invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
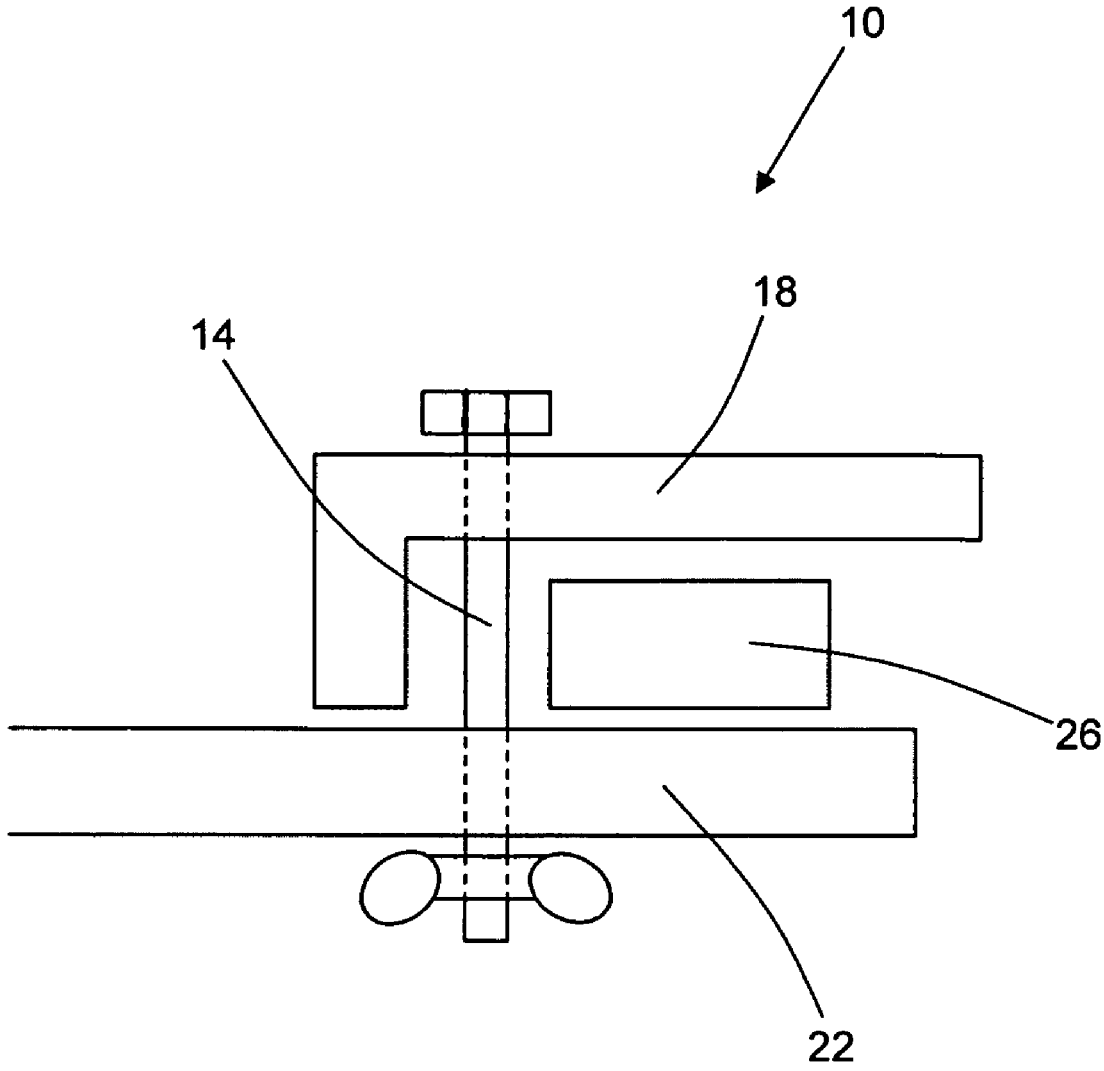
FIG. 1 (Prior Art)
FIG. 1 shows a top view of a target clamp known in the prior art.

Turning now to FIG. 1, a top view of a target clamp known in the prior art is shown. The target clamp 10 utilizes a bolt 14 to tighten a metal plate 18, which may be flat or formed in an L shape as shown, against a mounting arm 22 of the target stand or actuator. A target, or target mounting post 26 is held between the plate 18 and mounting arm 22 by tightening the bolt 14. Targets are frequently mounted to a mounting post 26 as the target is relatively thin and flexible.

A problem with existing target clamps 10 is that the target mounting post 26 is not securely held in place. The mounting arm 22 of many target stands or actuators is commonly a strip of plate steel. A lack of positive engagement between the mounting arm 22, target mounting post 26, and metal plate 18 allow the target mounting post to slip or pivot within the target clamp 10. This is especially true where the target is mounted to an actuator, as the rapid movement of the target actuator to move or turn the target into a desired position places elevated forces on the point of attachment of the target to the actuator.

Figure 2A:
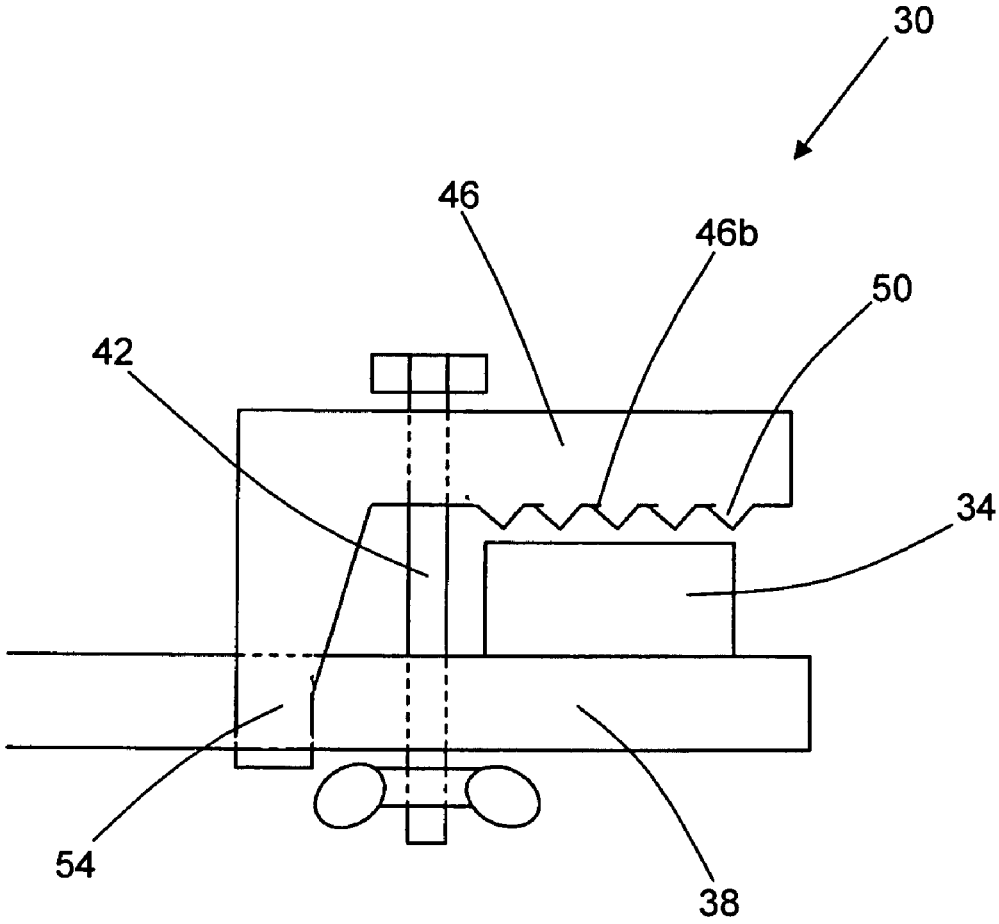
FIG. 2A shows a top view of a target clamp of the present invention.

Turning now to FIG. 2A, a top view of a target clamp 30 of the present invention is shown. The clamp 30 is used to hold a target or target mounting post 34 to the mounting arm 38 of a target stand or target actuator. A fastener 42, such as a bolt, and a clamping arm 46 is used to clamp the target mounting post 34 between the clamping arm 46 and the mounting arm 38. The clamping arm 46 is formed with a textured inner surface 46*b*, having a plurality of teeth 50 according to a present embodiment. The textured surface 46*b* effectively grips the target mounting post 34 and prevents movement of the target mounting post relative to the clamping arm 46. The teeth 50 may be larger when a wooden target mounting post 34 is used, or may be smaller when the mounting post is plastic or another material.

The clamping arm 46 also includes a pair of flanges 54 which extend beyond the mounting arm 38 and prevent rotation of the clamping arm 46 relative to the mounting arm 38. The combination of a textured surface 46*b* such as teeth 50 and the flanges 54 substantially prevent movement of the target mounting post 34 relative to the mounting arm 38.

Figure 2B:
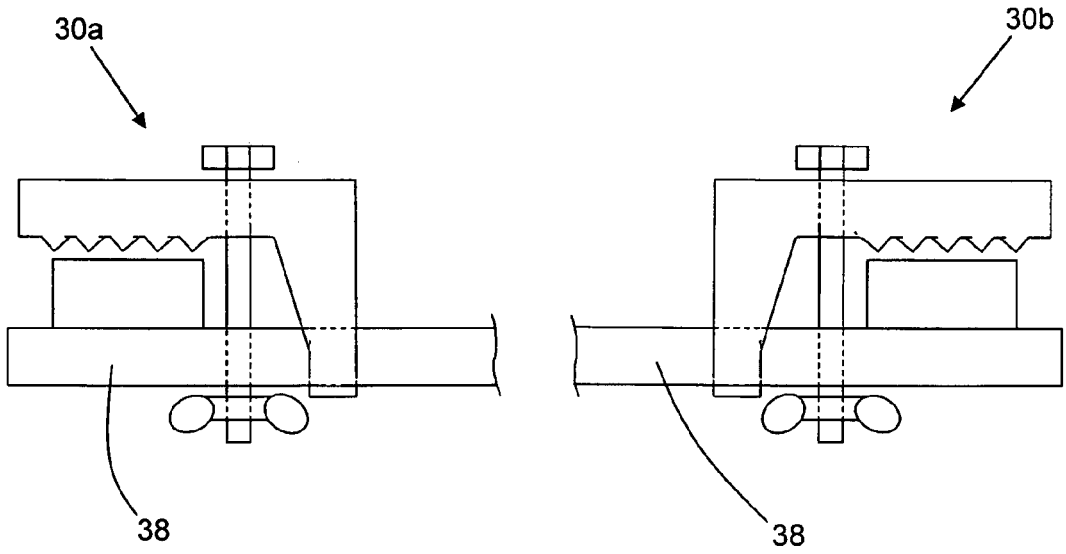
FIG. 2B shows a top view of a target clamping system of the present invention having two clamps.

In use, the target clamp f FIG. 2A may often be used in a pair. The mounting arm 38 may extend and have a first clamping arm 46 on one end and a second clamping arm 46 on the opposite end of the mounting arm. In such a configuration, the target clamp may hold two target mounting posts 34 spaced apart from each other, and a target may be attached to the two posts. FIG. 2B shows such a configuration, having a first target clamp 30*a* and a second target clamp 30*b* in accordance with the above description mounted to a mounting arm 38. It is appreciated that more than two clamps may be used together on a single mounting arm. Such may be desirable with larger targets, etc.

Figure 3:
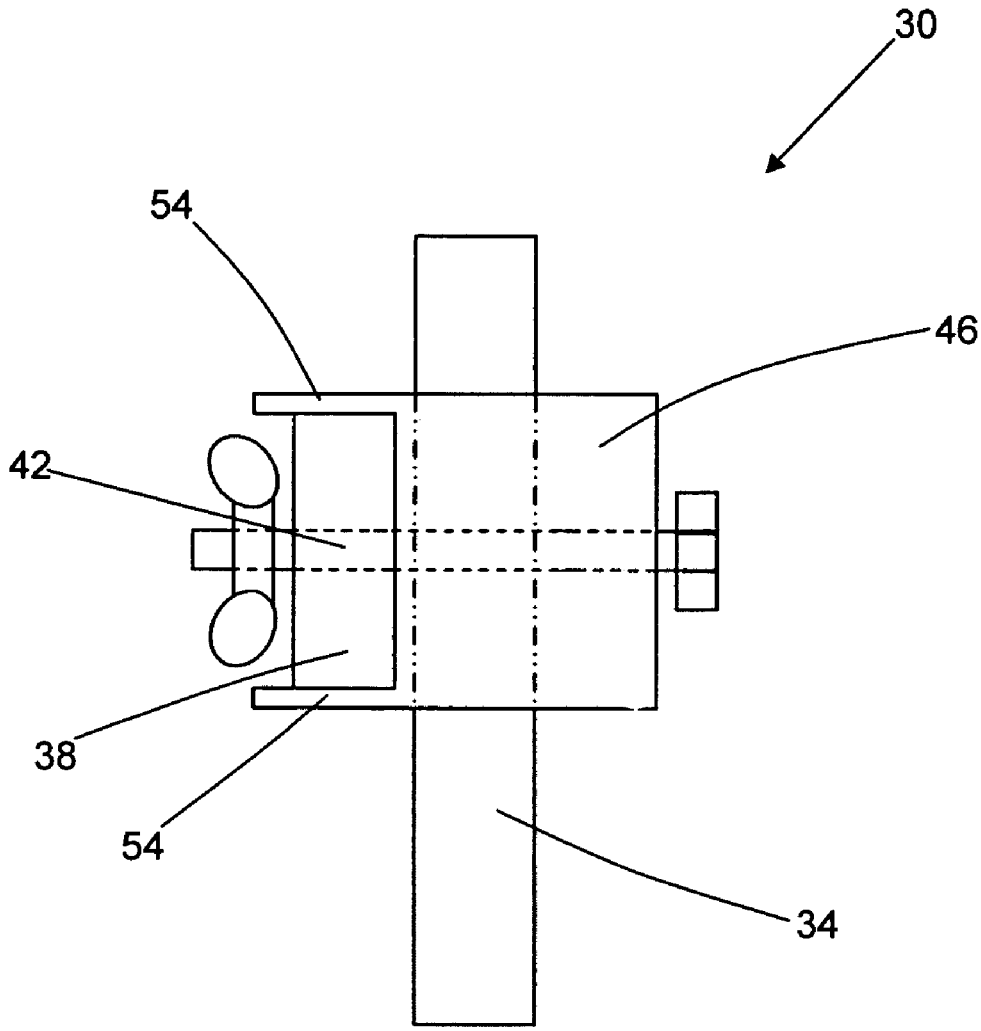
FIG. 3 shows a side view of the target clamp of FIG. 2A.

Turning now to FIG. 3, a side view of the target clamp of FIG. 2A is shown. FIG. 3 better illustrates how the flanges 54 extend around the mounting arm 38 to prevent rotation of the clamping arm 46 relative to the mounting arm 38.

Figure 4:
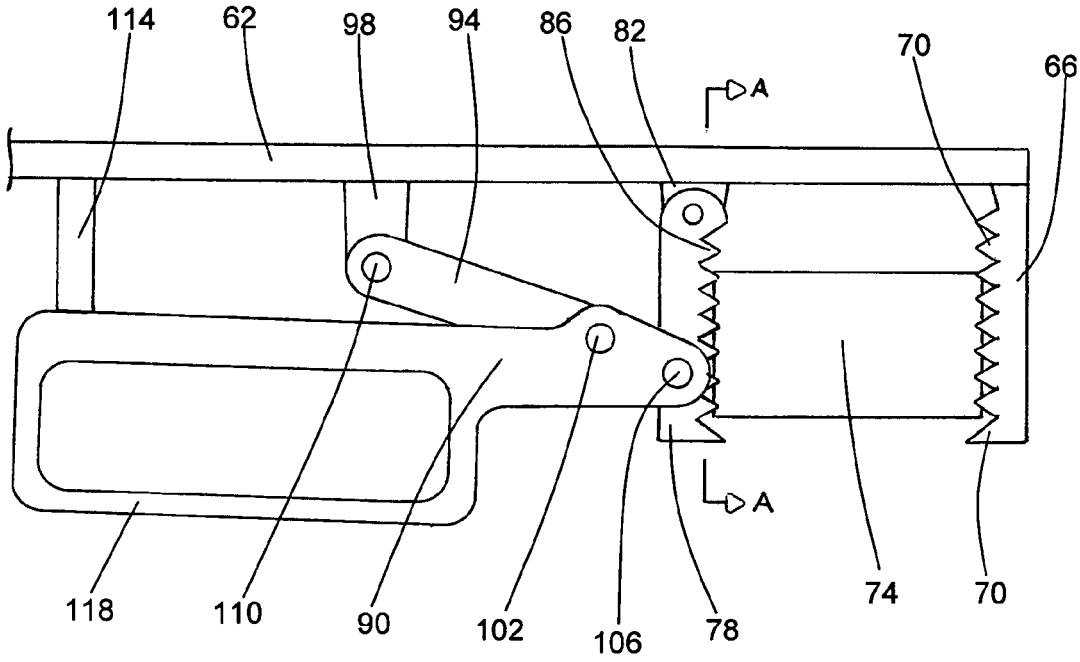
FIG. 4 shows a top view of a target clamp of the present invention.

Turning now to FIG. 4, a top view of another target clamp of the present invention is shown. The target clamp has a mounting arm 62 which may be part of a target stand or target actuator, or which may be mountable to the target stand or actuator. Or more stationary clamping arms 66 are attached to the mounting arm 62. The stationary clamping arms 66 are typically formed with a plurality of teeth 70 which more affirmatively grip a target mounting post 74. The target mounting post 74 is typically a wooden post as such are inexpensive and easily replaced. The target mounting post 74 is used to support a target, as targets are often of paper or cardboard.

The target mounting post 74 is clamped between the stationary clamping arms 66 and a movable clamping arm 78. The movable clamping arm 78 is typically mounted to the mounting arm 62 or a bracket 82, and is typically formed with a plurality of teeth 86 for more affirmatively gripping the target mounting post 74.

A locking lever 90 is pivotably attached to the movable clamping arm 78 and to a lever 94. The lever 94 is pivotably attached to the mounting arm 62 or to a bracket 98 attached to the mounting arm. The locking lever 90 and lever 94 are typically constructed such that, when in a closed position as shown, pivot point 102 is disposed slightly inwardly from pivot points 106 and 110 so as to lock the locking lever 90 in a closed position, clamping the target mounting post 74 between the stationary clamping arms 66 and the movable clamping arm 78. A stop 114 is typically used to limit the movement of the locking lever 90 in a closed position. A handle 118 may be provided for convenience in operating the clamp.

Figure 5:
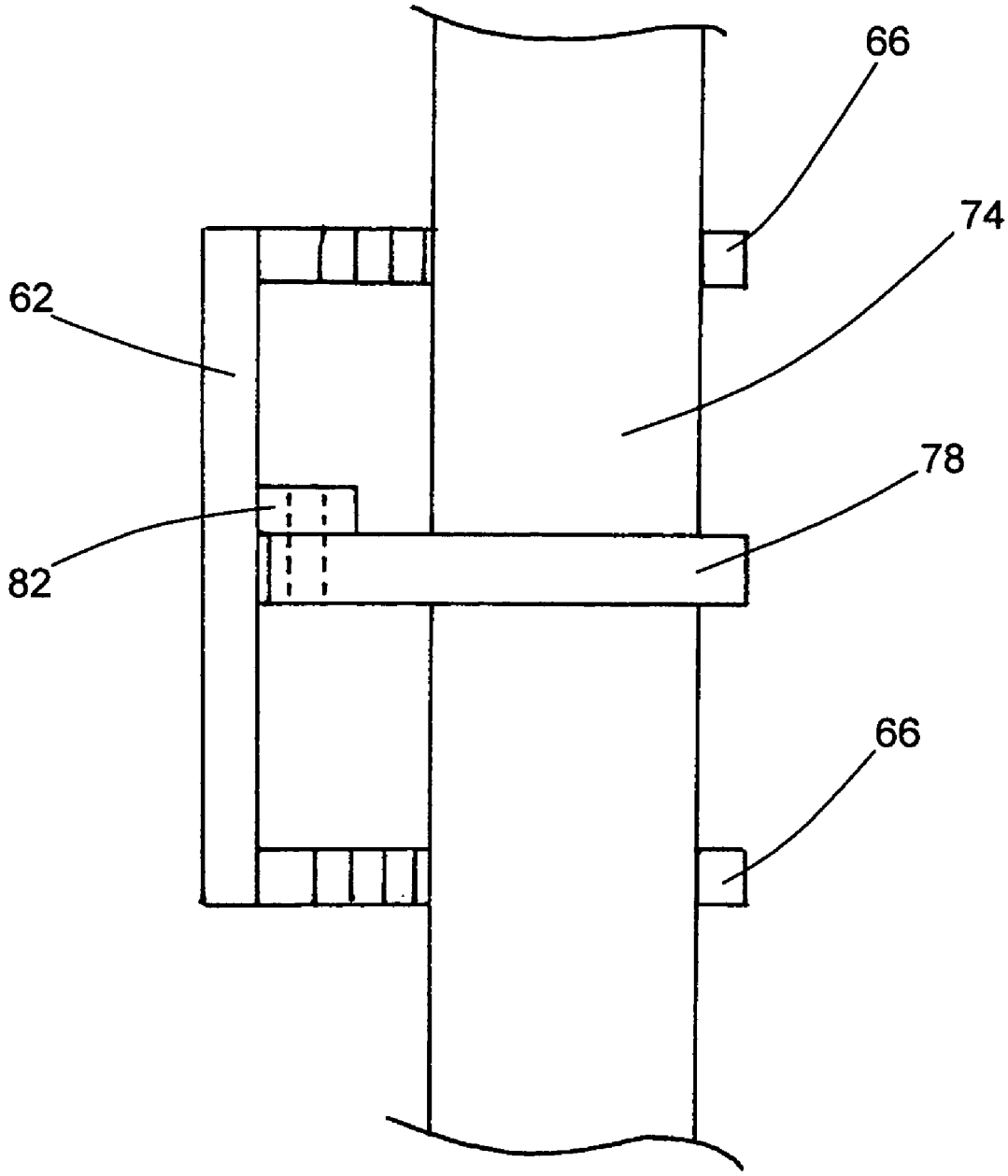
FIG. 5 shows a partial end view of the target clamp of FIG. 4 taken along line AA.

Turning now to FIG. 5, a partial side view of the clamp of FIG. 4 taken along line AA is shown. The clamp typically includes two stationary clamping arms 66. While a different number of clamping arms could be used, two stationary clamping arms and one movable clamping arm 78 provide simple construction and secure clamping of the target mounting post 74.

It is appreciated that a flexible paper target or a similar target will typically be mounted to two target mounting posts 74; one at either end of the target. Thus, a target mounting clamp according to the present invention may often comprise a mounting arm 62 with two target mounting clamps, typically at either end of the mounting arm, in a manner similar to that shown in FIG. 2B. The mounting arm is typically either part of a target actuator or stand or mountable to an actuator or stand. A target and target mounting posts 74 which are thus mounted in a target clamp are securely held in place even when subjected to repeated impact with bullets and to the rapid movement of a target actuator. Such a configuration will have two of the clamps of FIGS. 4 and 5, typically on opposite ends of a mounting arm 62. It is appreciated that more than two target clamps may be used on a single mounting arm as is desired.

There is thus disclosed an improved target clamp. It will be appreciated that numerous changes may be made to the present invention without departing from the scope of the claims.

What is claimed is:

1. A target system comprising:

a target having a first mounting post and a second mounting post;

a first mounting clamp comprising:

a mounting arm for engaging the first mounting post;

a first clamp arm disposed generally opposite at least part of the mounting arm;

a pair of flanges extending from the clamp arm and configured to contain the mounting arm between the flanges;

a first compressing device for forcing the first clamp arm toward the mounting arm and against the first mounting post; and a second mounting clamp comprising:

a mounting arm for engaging the second mounting post;

a second, L-shaped clamp arm disposed generally opposite at least part of the mounting arm;

one or more flanges disposed to overlap an engagement between the second, L-shaped clamp arm and the mounting arm to reduce rotation of the second, L-shaped clamp arm;

a second compressing device for forcing the second, L-shaped clamp arm toward the mounting arm and against the second mounting post.

2. The system of claim 1, wherein the first compressing device comprises a manual adjustment mechanism.

3. The system of claim 1, wherein the first compressing device comprises a bolt and nut.

4. The system of claim 1, wherein the second compressing device comprises a manual adjustment mechanism.

5. The system of claim 1, wherein the second compressing device comprises a bolt and nut.

6. A mounting clamp of claim 1, wherein the one or more flanges disposed to overlap an engagement between the second L-shaped clamp arm and the mounting arm are attached to the second, L-shaped clamp arm.

7. A mounting clamp of claim 1, wherein the first clamp arm further comprises one or more projections on the clamping arm for engaging the target.

* * * * *